US011259674B2

(12) United States Patent
Cottrell et al.

(10) Patent No.: US 11,259,674 B2
(45) Date of Patent: Mar. 1, 2022

(54) HOSE CLIP ARRANGEMENT FOR USE WITH CLEANING DEVICE AND/OR OTHER DEVICES

(71) Applicant: SHARKNINJA OPERATING LLC, Needham, MA (US)

(72) Inventors: Lee M. Cottrell, Newton, MA (US); Mingshun Su, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 8 days.

(21) Appl. No.: 15/695,730

(22) Filed: Sep. 5, 2017

(65) Prior Publication Data

US 2018/0064301 A1 Mar. 8, 2018

Related U.S. Application Data

(60) Provisional application No. 62/383,075, filed on Sep. 2, 2016.

(51) Int. Cl.
*A47L 9/00* (2006.01)
*A47L 9/24* (2006.01)
(Continued)

(52) U.S. Cl.
CPC ..... *A47L 9/0036* (2013.01); *A47L 5/225* (2013.01); *A47L 5/32* (2013.01); *A47L 9/242* (2013.01); *A47L 9/248* (2013.01); *A47L 9/32* (2013.01)

(58) Field of Classification Search
CPC ..... A47L 5/225; A47L 5/32; A47L 9/0036; A47L 9/0045; A47L 9/242; A47L 9/248;
(Continued)

(56) References Cited

U.S. PATENT DOCUMENTS 2,181,178 A * 11/1939 Duncan ..... B60D 1/065 280/513
3,220,041 A * 11/1965 Jepson ..... A47L 9/2842 15/323
(Continued)

FOREIGN PATENT DOCUMENTS

GB 2425248 A 10/2006
WO 2009077753 A1 6/2009
WO WO-2009077753 A1 * 6/2009 ..... A47L 9/248

OTHER PUBLICATIONS

PCT International Search Report and Written Opinion dated Nov. 16, 2017, received in corresponding PCT Application No. PCT/US17/50096, 9 pgs.
(Continued)

*Primary Examiner* — Joseph J Hail
*Assistant Examiner* — Arman Milanian
(74) *Attorney, Agent, or Firm* — Grossman Tucker Perreault & Pfleger, PLLC

(57) ABSTRACT

A hose clip for coupling at least a portion of a suction hose to a support structure of a vacuum cleaning apparatus may include a protrusion and a coupler. The coupler may include a coupler housing having an opening for receiving at least a portion of the protrusion. The opening may transition from an outer surface of the coupler housing into a coupler cavity defined by the coupler housing. The coupler cavity may include a plurality of jaws for engaging at least a portion of the protrusion.

17 Claims, 7 Drawing Sheets

(51) Int. Cl.
*A47L 9/32* (2006.01)
*A47L 5/22* (2006.01)
*A47L 5/32* (2006.01)

(58) Field of Classification Search
CPC ..... A47L 9/32; F16B 2200/10; F16C 11/069; Y10S 24/60; Y10T 403/32786; Y10T 403/32631; Y10T 403/32803; Y10T 403/604
USPC ..... 15/323; 403/135, 140, 143, 76, 90; 24/657, 545, DIG. 6; 248/75
See application file for complete search history.

(56) References Cited

U.S. PATENT DOCUMENTS 4,361,939 A * 12/1982 Gelula ..... A44B 11/2515 24/631
5,142,731 A * 9/1992 Resch ..... A47L 9/0045 15/323
5,586,360 A * 12/1996 Diederiks, Jr. ..... A47L 9/02 15/410
6,151,754 A * 11/2000 Chen ..... E05C 17/52 16/85
6,343,824 B1 * 2/2002 Foy ..... A44B 11/2519 24/579.11
7,322,127 B2 * 1/2008 Hwang ..... D06F 39/14 34/595
8,296,897 B2 10/2012 Moore
8,522,394 B2 * 9/2013 Lee ..... A47L 9/0036 15/323
2006/0251471 A1 * 11/2006 Chen ..... F16C 11/069 403/122
2009/0223018 A1 * 9/2009 Hong ..... A47L 5/32 15/416
2010/0325831 A1 * 12/2010 Lee ..... A47L 9/0027 15/323
2013/0236238 A1 * 9/2013 Burton ..... F16C 11/06 403/135
2016/0174793 A1 6/2016 Burke et al.

OTHER PUBLICATIONS

Canadian Office Action dated Feb. 18, 2020, received in Canadian Application No. 3,035,828,4 pgs.
Chinese Office Action with English translation dated Jun. 15, 2020, received in Chinese Application No. 201780053569.6, 13 pgs.
Chinese Office Action with English translation dated Jan. 5, 2021, received in Chinese Application No. 201780053569.6, 12 pages.
Chinese Decision of Rejection with English translation dated Jul. 1, 2021, received in Chinese Patent Application No. 201780053569.6, 8 pages.

* cited by examiner

HOSE CLIP ARRANGEMENT FOR USE WITH CLEANING DEVICE AND/OR OTHER DEVICES

CROSS-REFERENCE TO RELATED APPLICATIONS

The present disclosure claims the benefit of U.S. Provisional Patent Application Ser. No. 62/383,075 filed Sep. 2, 2016, which is fully incorporated herein by reference.

TECHNICAL FIELD

The present disclosure relates to attachment mechanisms and, more particularly, to a hose clip for coupling a suction hose to a device such as a vacuum cleaner.

BACKGROUND INFORMATION

Devices, such as vacuum cleaners, include multiple components and/or attachments that are useable by an operator to accomplish a task (e.g., cleaning a surface). In a vacuum cleaner, the operator may use one or more cleaning attachments that each couple to a suction hose. When not in use, the cleaning attachments and the suction hose may be removeably coupled to the vacuum cleaner such that the operation of the vacuum cleaner is not substantially impeded.

In these instances, before using a cleaning attachment, both the cleaning attachment and the hose may be required to be uncoupled from the vacuum cleaner. Once uncoupled from the vacuum cleaner, one end of the suction hose is recoupled to the vacuum cleaner at a suction port and the other end of the suction hose is connected to a cleaning attachment. In other words, the suction hose is uncoupled from one location on the vacuum cleaner such that the suction hose can be recoupled to the vacuum cleaner at another location.

One approach to avoiding the need to uncouple and recouple the suction hose with the vacuum cleaner is to integrate the suction hose with the vacuum cleaner. As a result, when the suction hose is uncoupled from the vacuum cleaner it is already coupled to the suction port, reducing the number of steps necessary to use a cleaning attachment. However, even under this approach, at least a portion of the suction hose may be frequently connected and disconnected from the vacuum cleaner each time a cleaning attachment is used. As such, by integrating the suction hose with the vacuum cleaner, the uncoupling process may introduce additional complications.

BRIEF DESCRIPTION OF THE DRAWINGS

These and other features and advantages will be better understood by reading the following detailed description, taken together with the drawings, wherein.

DETAILED DESCRIPTION

A hose clip, consistent with embodiments herein, is used with a device, such as a vacuum cleaning apparatus. In an embodiment, the hose clip includes a coupler and a hose ring. The coupler is coupled to the vacuum cleaning apparatus. The hose ring at least partially surrounds a suction hose. An inner surface of the hose ring engages the suction hose. An outer surface of the hose ring includes a protrusion that extends outwardly in a direction away from the suction hose. The coupler includes a housing that defines a cavity. An opening transitions from an outer surface of the housing into the cavity. The protrusion is inserted into the opening such that at least a portion of the protrusion extends into the cavity. While the protrusion is inserted within the opening, the hose ring is coupled to the coupler. The protrusion may be removed from the opening when an operator of the vacuum cleaning apparatus applies a force to the hose ring. In other words, the hose ring may be repeatably coupled to and uncoupled from the coupler by an operator of the vacuum cleaning apparatus.

Figure 1:
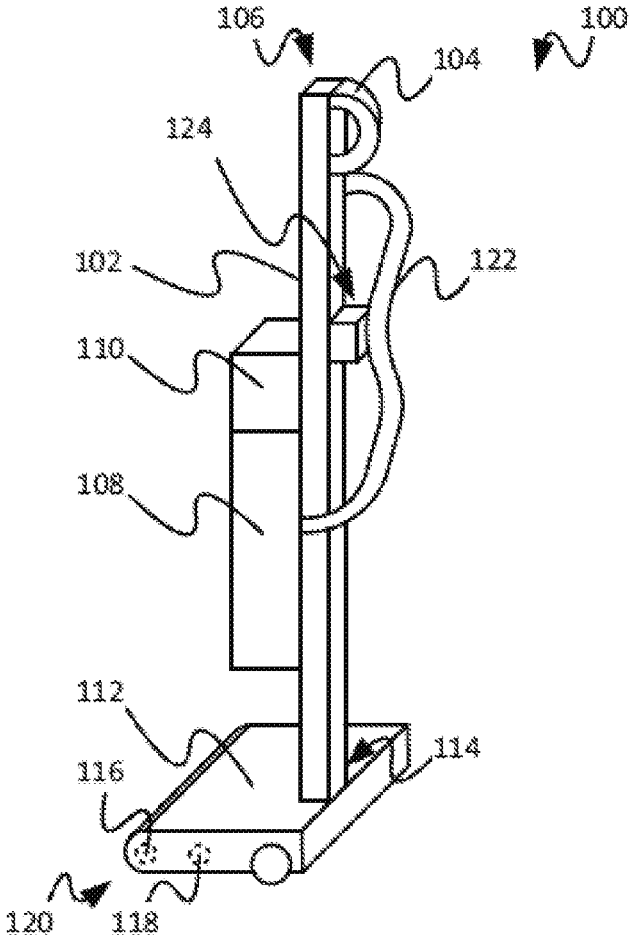
FIG. 1 is a schematic perspective view of an example of a vacuum cleaning apparatus, consistent with embodiments of the present disclosure.

Referring to FIG. 1, in an embodiment, a vacuum cleaning apparatus 100 includes a support structure 102 (e.g., a wand) having a handle 104 coupled at a first end 106 of the support structure 102. A debris collector 108 is coupled to the support structure 102. The debris collector 108 is fluidly coupled to a suction motor 110 and a surface cleaning head 112. The surface cleaning head 112 is coupled at a second end 114 of the support structure 102. The surface cleaning head 112 includes a brush roll 116 (shown in hidden lines in FIG. 1). The brush roll 116 may be coupled to a brush roll motor 118 (shown in hidden lines in FIG. 1) such that the brush roll motor 118 causes the brush roll 116 to be rotated within the surface cleaning head 112. The suction motor 110 generates a vacuum within the debris collector 108 such that debris is drawn from the surface to be cleaned through a dirty air inlet 120 of the surface cleaning head 112 and is deposited within the debris collector 108.

In some embodiments, at least a portion of the support structure 102 is hollow. The hollow portion of the support structure 102 is in fluid communication with the surface cleaning head 112 and the debris collector 108. As such, debris drawn into the surface cleaning head 112 passes through at least a portion of the support structure 102 before being deposited in the debris collector 108. In these embodiments, the support structure 102 may be fluidly coupled to the surface cleaning head 112 and the debris collector 108 using a suction hose 122. For example, a first end of the suction hose 122 may be fluidly coupled to the debris collector 108 and a second end of the suction hose 122 may be fluidly coupled to the support structure 102 at a location adjacent to the handle 104. To prevent the suction hose 122 from interfering with the operation of the vacuum cleaning apparatus 100, a portion of the suction hose 122 may be coupled to the support structure 102 using a hose clip 124.

Figure 2:
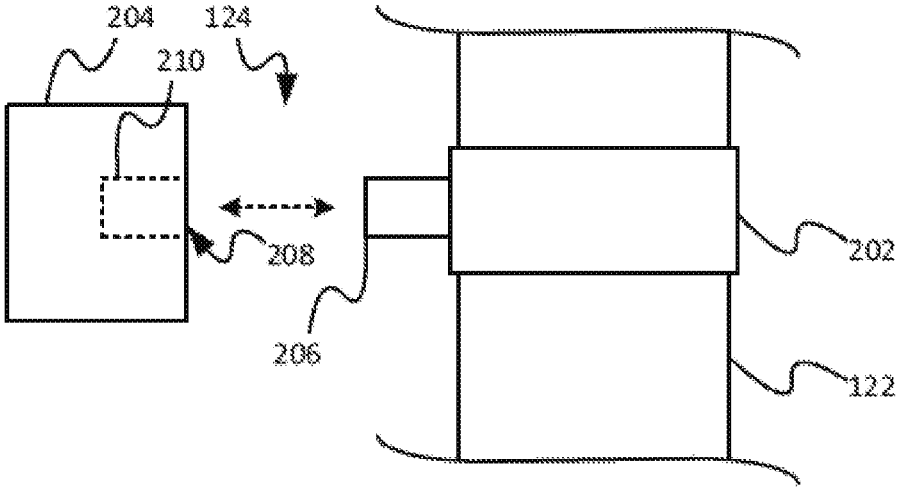
FIG. 2 is a schematic view of an example hose clip to be used with the vacuum cleaning apparatus of FIG. 1, consistent with embodiments of the present disclosure.

Referring also to FIG. 2, as shown the hose clip 124 includes a hose ring 202 capable of being coupled to a coupler 204. The hose ring 202 includes a protrusion 206. The protrusion 206 extends from an exterior surface of the hose ring 202 and the suction hose 122 extends through an opening defined by the hose ring 202. At least a portion of the protrusion 206 is received within an opening 208 (shown in hidden lines in FIG. 2). The opening 208 extends at least partially through the coupler 204, defining a cavity 210 within the coupler 204. When the protrusion 206 is received within the opening 208 of the coupler 204, the hose ring 202 is removeably coupled to the coupler 204. In other words, the hose ring 202 may be repeatably coupled to and uncoupled from the coupler 204.

Figure 3:
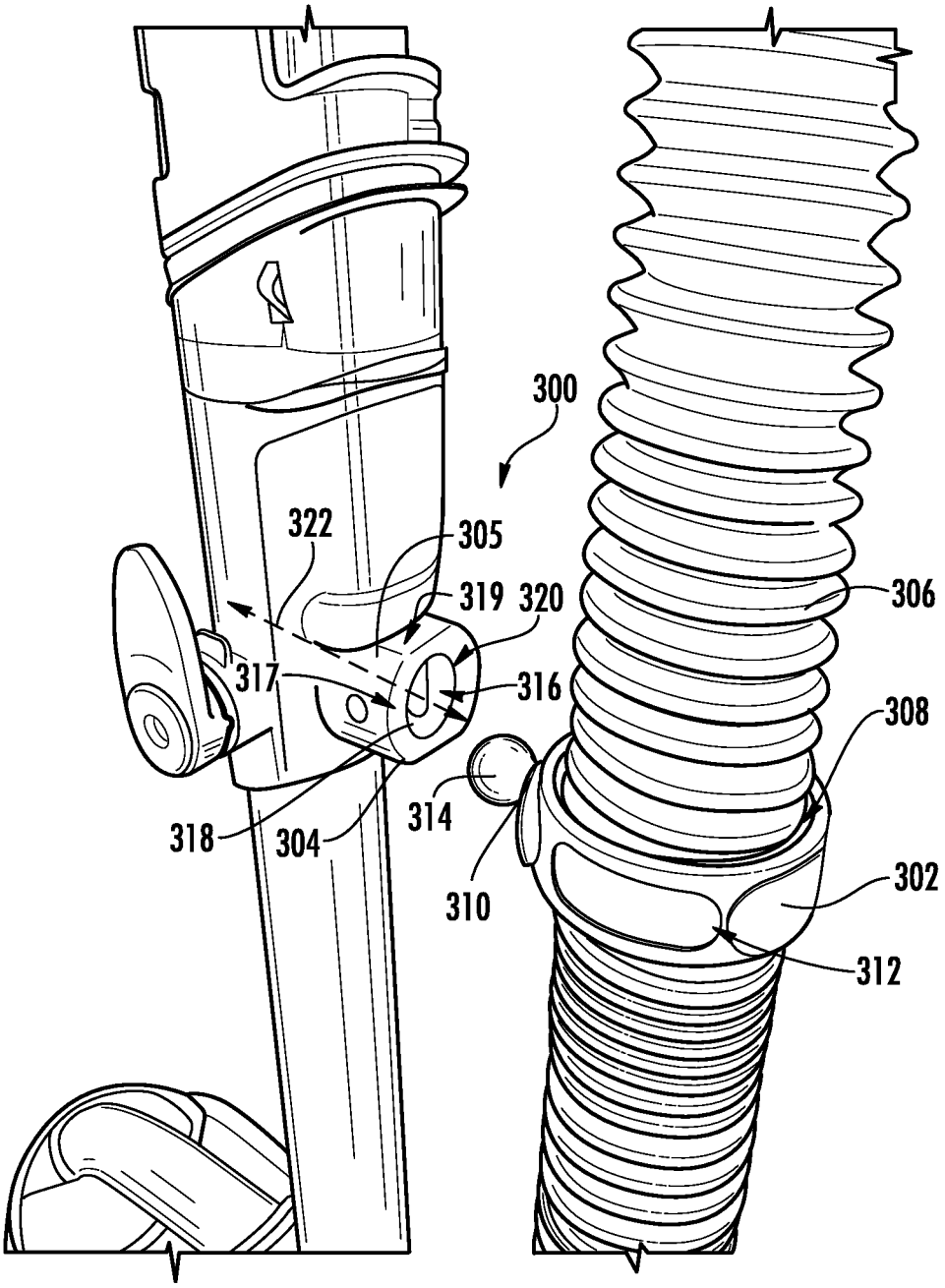
FIG. 3 is an example of a hose clip for use with a vacuum cleaning apparatus, consistent with embodiments of the present disclosure.

Referring also to FIG. 3, an example of a hose clip 300 is shown, which may be an example of the hose clip 124 of FIGS. 1 and 2. As shown, the hose clip 300 includes a hose ring 302 and a coupler 304. The hose ring 302 at least partially surrounds a suction hose 306 such that an inner surface 308 of the hose ring 302 engages (e.g., slideably engages) the suction hose 306. A protrusion 310 extends from an outer surface 312 of the hose ring 302 in a direction away from the suction hose 306. The protrusion 310 includes a coupling 314 (e.g., a ball shaped member). At least a portion of the coupling 314 and/or the protrusion 310 are received within the coupler 304 such that the hose ring 302 is coupled to the coupler 304.

As shown, the coupler 304 includes a coupler housing 305 defined by one or more sidewalls. A coupler opening 316 transitions from an outer surface 317 of the coupler housing 305 into a coupler cavity 319. The coupler opening 316 receives at least a portion of the coupling 314 and/or the protrusion 310. As shown, the coupler cavity 319 is defined by an inner surface 320 of the coupler housing 305 and includes one or more jaws 318. Each of the one or more jaws 318 may biased towards a center axis 322 of the coupler opening 316. Therefore, when at least a portion of the coupling 314 is inserted through the coupler opening 316 and into the coupler cavity 319 the one or more jaws 318 exert a compressive force on the coupling 314 and/or the protrusion 310. The compressive force exerted by the one or more jaws 318 may assist in retaining at least a portion the coupling 314 and/or protrusion 310 within the coupler cavity 319.

Figure 4:
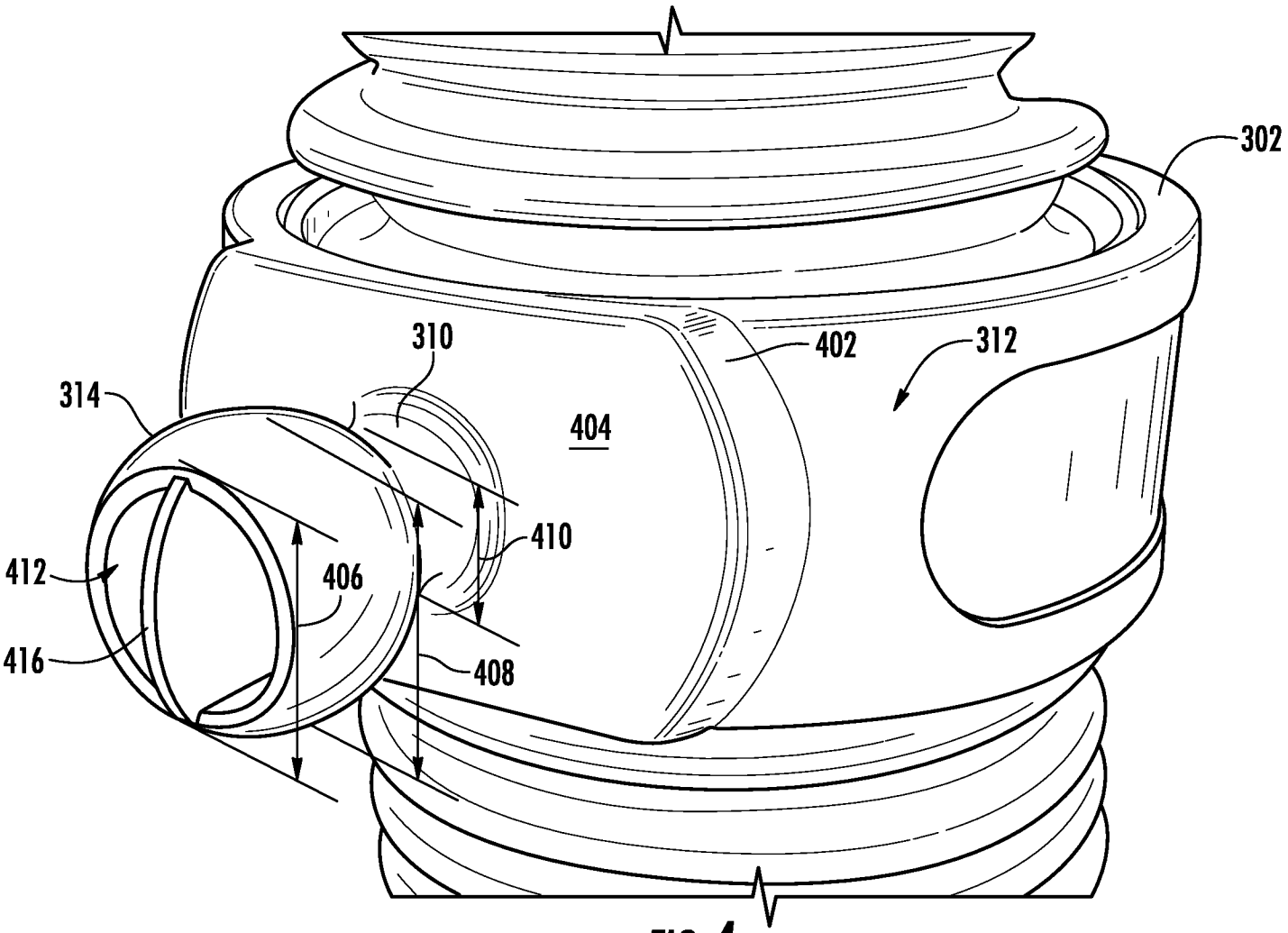
FIG. 4 is an example of a hose ring for use with the hose clip of FIG. 3, consistent with embodiments of the present disclosure.

Referring also to FIG. 4, a platform 402 may extend from the outer surface 312 of the hose ring 302. As shown, the platform 402 may define a substantially planar surface 404 from which the protrusion 310 extends. Therefore, when the coupling 314 is received within the coupler opening 316 (FIG. 3) of the coupler 304 (FIG. 3), the platform 402 may be adjacent to and/or in contact with the coupler 304. As such, when the hose ring 302 is coupled to the coupler 304, the platform 402 may substantially prevent the hose ring 302 from pivoting relative to the coupler 304 (e.g., pivoting or rotating transverse to the center axis 322).

As shown, the coupling 314 may define a coupling cavity 412. The coupling cavity 412 may include a fin 416 that extends out of the coupling cavity 412. In some embodiments, the portion of the fin 416 that extends out of the coupling cavity 412 may have a curvature defined by a radius that is substantially equal to a radius of a curved portion of the coupling 314. In operation, the fin 416 may assist in inserting the coupling 314 into the coupler 304. For example, when the coupler 304 includes a plurality of jaws 318 (FIG. 3), the fin 416 may serve to initially separate the jaws 318. In some embodiments, the fin 416 may align the coupling 314 with the coupler opening 316 of the coupler 304. Further, in some embodiments, the coupler 304 may include a corresponding groove/recess within the coupler cavity 319 (FIG. 3) that receives the fin 416. In these situations, the interaction between the fin 416 and the corresponding groove/recess may substantially prevent the hose ring 302 from rotating relative to the coupler 304 (e.g., rotating or pivoting about the center axis 322). As such, when the hose ring 302 also includes the platform 402, the hose ring 302 may be substantially prevented from rotating/pivoting about and transverse to the center axis 322 of the coupler 304.

As shown, the coupling 314 has an insertion end width 406. The insertion end width 406 transitions to an intermediary width 408. The intermediary width 408 transitions to a protrusion end width 410. As shown, both the insertion end width 406 and the protrusion end width 410 measure less than the intermediary width 408. For example, the intermediary width 408 may represent the widest width of the coupling 314. However, such a configuration is not required, for example, both the insertion end width 406 and the protrusion end width 410 may measure greater than the intermediary width 408. Alternatively, for example, the insertion end width 406 may be less than the intermediary width 408 and the protrusion end width 410 may be equal to the intermediary width 408.

As shown, the coupling 314 has an at least partially spherical shape. For example, the coupling 314 may generally resemble a truncated sphere. Therefore, at least a portion of the coupling 314 may have a generally spherical surface. However, in some embodiments, the coupling 314 may not be spherical. For example, the coupling 314 may, be conical shaped, cylindrical shaped, concave shaped (e.g., when the insertion end width 406 and the protrusion end width 410 measure greater than the intermediary width 408), or any other suitable shape.

Figure 5:
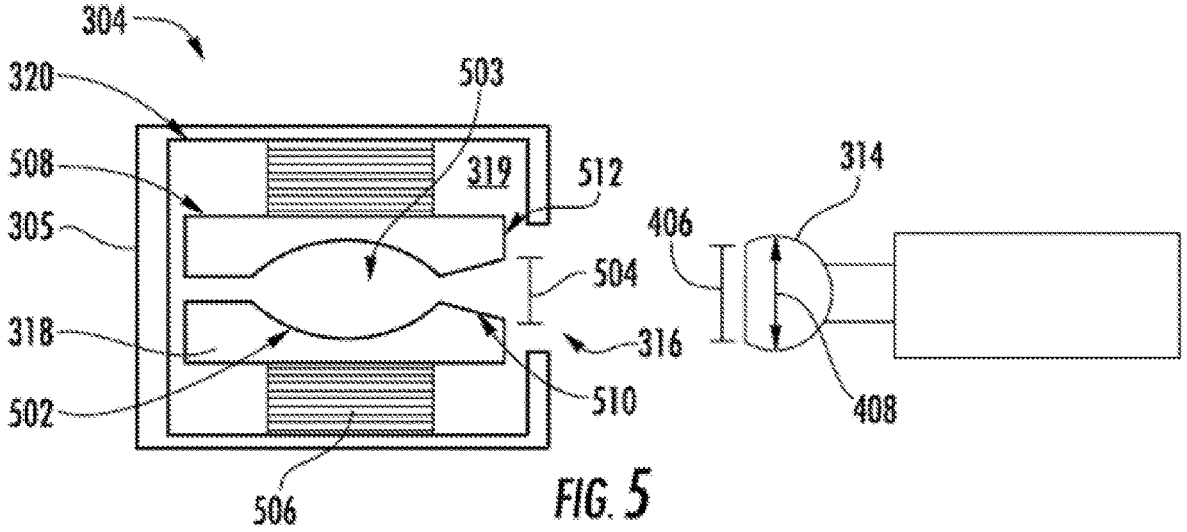
FIG. 5 is a schematic cross-sectional view of an example of the hose clip of FIG. 3, consistent with embodiments of the present disclosure.

As shown in FIG. 5, and with continued reference to the preceding figures, the coupler 304 includes a plurality of jaws 318 disposed within the coupler cavity 319. Each of the jaws 318 includes an engaging surface 502 for engaging at least a portion of the coupling 314 and/or the protrusion 310. At least one of the engaging surfaces 502 may define a recess 503 having a shape that generally corresponds to at least a portion of the coupling 314. For example, at least a portion the recess 503 may have a curvature that has a radius that generally corresponds to at least a portion of a spherical surface of the coupling 314. In some embodiments, the recess 503 may have a curvature that has a radius greater than the radius of a spherical surface of the coupling 314. Alternatively, or additionally, one or more of the engaging surfaces 502 may include a plurality of substantially planar surfaces each having an opposite slope such that a V-shape is formed. In other words, at least one of the engaging surfaces 502 may form a V-block. In some embodiments, one or more of the engaging surfaces 502 may be substantially planar.

As also shown in FIG. 5, one or more of the jaws 318 may include one or more tapered regions 510. Each of the tapered regions 510 may taper from an opening facing end 512 of the jaws 318. The slope of the tapered regions 510 may be selected such that a separation distance 504 between the jaws 318 at the opening facing end 512 is greater than or equal to the insertion end width 406 of the coupling 314 prior to the coupling 314 being inserted between the jaws 318. In other words, the separation distance 504 at one or more locations along the tapered regions 510 may measure greater than or equal to the insertion end width 406.

When the coupling 314 is received within the coupler opening 316 of the coupler 304, the insertion end width 406 causes each of the jaws 318 to separate. As the coupling 314 is inserted, the jaws 318 will continue to separate until a change in a separation distance 504 of the jaws 318 is equal to, for example, the intermediary width 408 of the coupling 314. Then, with continued insertion, assuming the protrusion end width 410 (FIG. 4) is less than the intermediary width 408 and the jaws 318 include the recess 503, the separation distance 504 of the jaws 318 will begin to decrease. As a result, when the coupling 314 is fully inserted into the coupler 304, the corresponding curvatures between the coupling 314 and the engaging surface 502 of the jaws 318 assists in the retention of the coupling 314 within the coupler 304.

Further retention assistance may be provided by one or more biasing members 506. The biasing members 506 may extend between the inner surface 320 of the coupler housing 305 and an outer surface 508 of the jaws 318. In some embodiments, the biasing members 506 may be coupled to one or both of the inner surface 320 of the coupler housing 305 and/or the outer surface 508 of the jaws 318. The biasing members 506 may be any combination of springs, compressible materials (e.g., rubber), hydraulics, or any other suitable biasing mechanism.

Figure 6:
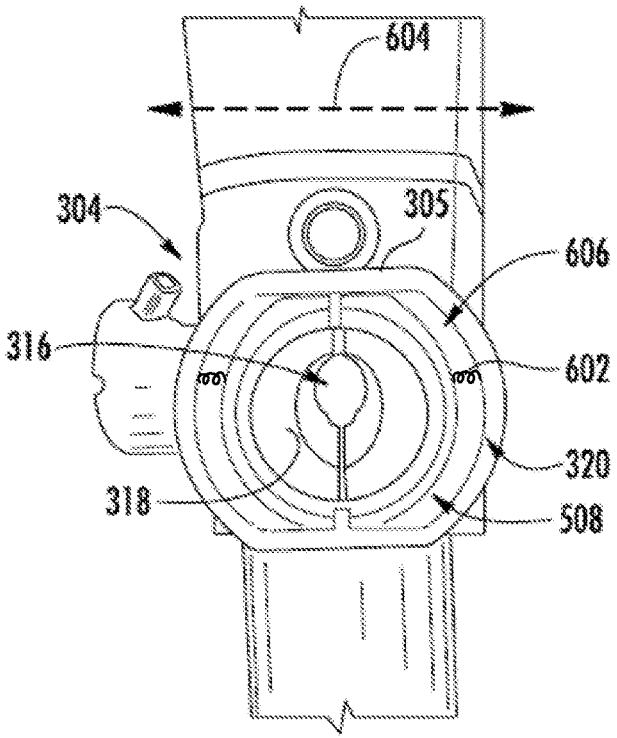
FIG. 6 is a plan view of an example of a coupler for use with the hose clip of FIG. 3, consistent with embodiments of the present disclosure.

Referring also to FIG. 6, the coupler 304 may include a plurality of jaws 318 biased towards the center axis 322 (FIG. 3) of the coupler opening 316 by a respective compression spring 602. The compression spring 602 may be positioned between the inner surface 320 of the coupler housing 305 and the outer surface 508 of the jaws 318. When the coupling 314 (FIG. 3) is received within the coupler opening 316, the jaws 318 move along a transverse axis 604 (e.g., move substantially parallel to the transverse axis 604) such that the separation distance 504 (FIG. 5) between the jaws 318 is increased. The transverse axis 604 is transverse to (e.g., perpendicular to) the center axis 322. As the separation distance 504 increases, the compressive force exerted by the compression springs 602 increases. As a result, when the coupling 314 (FIG. 3) is fully received within the coupler 304, the compressive forces exerted by the compression springs 602 serve to at least partially retain the coupling 314 within the coupler 304.

When removing the coupling 314 from the coupler 304 at least a portion of a removal force is exerted generally parallel to the center axis 322 (FIG. 3) of the coupler opening 316. Each jaw 318 may be sized to be larger than the coupler opening 316 such that the jaws 318 are not removed from the coupler 304 when the coupling 314 is removed from the coupler 304. In other words, an end wall 606 of the coupler housing 305 may directly and/or indirectly engage each jaw 318 at least when coupling 314 is removed from the coupler 304.

Figure 7:
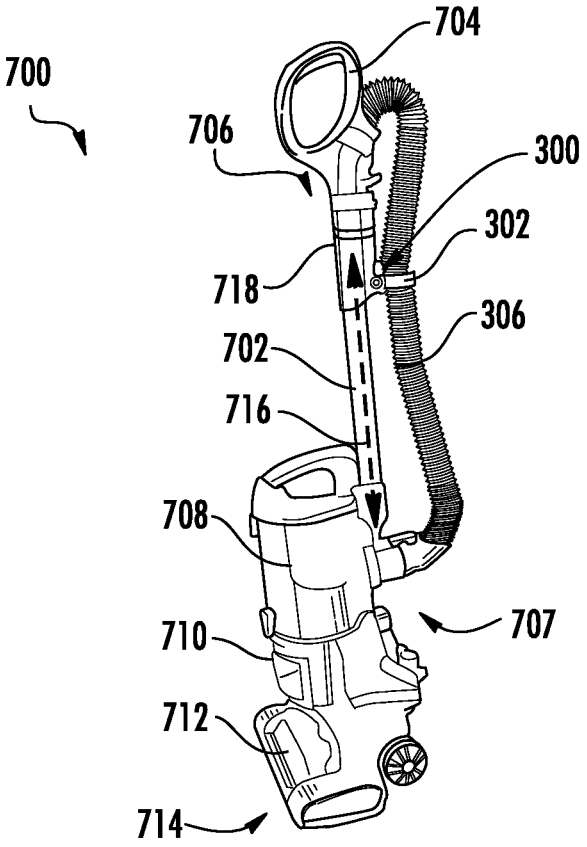
FIG. 7 is an example of a vacuum cleaning apparatus using the hose clip of FIG. 3, consistent with embodiments of the present disclosure.

Referring also to FIG. 7, the hose clip 300 may be coupled to a vacuum cleaning apparatus 700, which may be one embodiment of the vacuum cleaning apparatus 100 of FIG. 1. As shown, the vacuum cleaning apparatus 700 includes a support structure 702 (e.g., wand) having a handle 704 coupled to a first end 706 of the support structure 702. A debris collector 708 is coupled to the support structure 702. The debris collector 708 is fluidly coupled a suction motor 710 and a surface cleaning head 712 such that, when the suction motor 710 is activated, debris is drawn through a dirty air inlet 714 of the surface cleaning head 712 and deposited in the debris collector 708. The surface cleaning head 712 is coupled to a second end 707 of the support structure 702. As shown, the suction hose 306 fluidly couples the debris collector 708 to the surface cleaning head 712 through a channel extending at least partially along a longitudinal axis 716 of the support structure 702. In other words, the support structure 702 is at least partially hollow. As shown, the suction hose 306 is fluidly coupled to the support structure 702 via the handle 704. The handle 704 may be detachably coupled to the support structure 702 using a connector 718. The connector 718 may be coupled to the support structure 702. As such, the connector 718 may fluidly couple the suction hose 306 to the support structure 702.

As shown, at least a portion of the hose clip 300 is coupled to and/or formed from the connector 718. The hose clip 300 couples at least a portion of the suction hose 306 to the support structure 702 such that the suction hose 306 does not interfere with the operation of the vacuum cleaning apparatus 700. To provide further adjustability, the suction hose 306 may be slideable within the hose ring 302. However, the hose ring 302 may generally prevent the suction hose 306 from sliding relative to the hose ring 302 absent an external force exerted by, for example, an operator of the vacuum cleaning apparatus 700. In other words, a friction fit may be formed between the hose ring 302 and the suction hose 306 such that the suction hose 306 does not inadvertently slide relative to the hose ring 302. Alternatively, or additionally, the hose ring 302 may be hinged such that the position of the suction hose 306 relative to the hose ring 302 may be adjusted.

Figure 8:
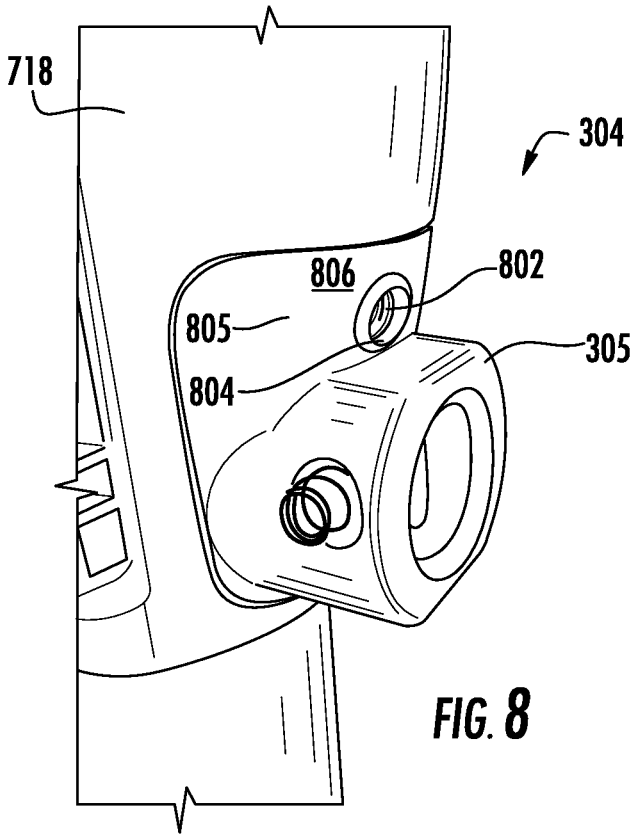
FIG. 8 is an example of the coupler of FIG. 6 coupled to the vacuum cleaning apparatus of FIG. 7, consistent with embodiments of the present disclosure.

As shown in FIG. 8, and with continued reference to the preceding figures, the coupler 304 may be coupled to the support structure 702 and/or the connector 718 using a mounting element 805 that extends from the coupler housing 305. As shown, the coupler 304 is mounted to the connector 718 using a threaded member 802 (e.g., a screw or a bolt) extending through the mounting element 805 of the coupler 304. The threaded member 802 may be received within an opening 804 that extends through the mounting element 805. The opening 804 may be recessed relative to a hose facing surface 806 of the mounting element 805. Additionally, or alternatively, the coupler 304 may be mounted to the connector 718 using any combination of adhesives, mechanical couplers (such as snap fits), friction fits, or other suitable couplers. Alternatively, in some embodiments, the coupler 304 may be integrally formed with the connector 718. In some embodiments, the coupler 304 may be coupled to the handle 704 (FIG. 7).

Figure 9:
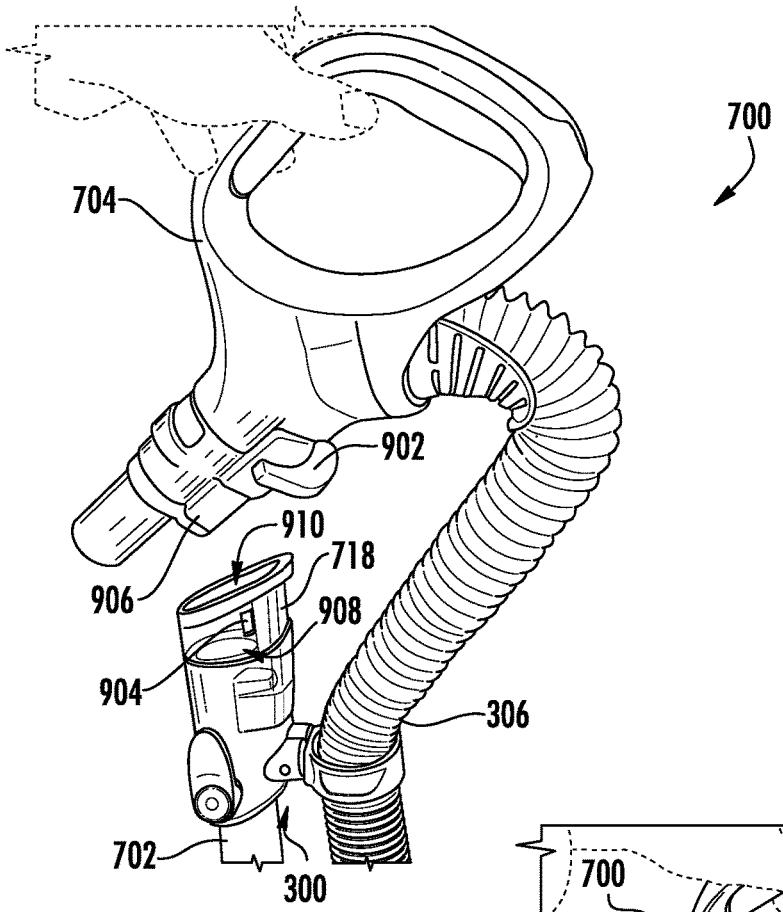
FIG. 9 is an example of the vacuum cleaning apparatus of FIG. 7, consistent with embodiments of the present disclosure.

As shown in FIG. 9, and with continued reference to the preceding figures, the handle 704 may be detachable from the support structure 702 using a release mechanism 902 in communication with the connector 718. For example, the connector 718 may include one or more openings 904 extending at least partially through the connector 718. The one or more openings 904 may engage a corresponding one or more retractable extensions 906, wherein, when the release mechanism 902 is actuated, the retractable extensions 906 disengage the one or more openings 904 such that the handle can be disconnected from the connector 718. Additionally, or alternatively, the handle 704 may be coupled to the support structure using one or more of a friction fit, a snap fit, one or more detents, or other suitable forms of coupling that allow an operator to attach and detach the handle 704 from the support structure 702.

As shown, the support structure 702 is hollow and an inner surface 908 of the support structure 702 defines a channel 910 that extends longitudinally within the support structure 702. Therefore, when the handle 704 is detached from the support structure 702, the suction hose 306 is no longer fluidly coupled to the channel 910. Once detached, one or more vacuum attachments may be coupled to the handle 704 to provide additional versatility to the vacuum cleaning apparatus 700.

As shown, when the handle 704 is detached from the support structure 702, the suction hose 306 remains coupled to the support structure 702 using the hose clip 300. As such, movement of the handle 704 may be restricted while the suction hose 306 is coupled to the coupler 304.

Figure 10:
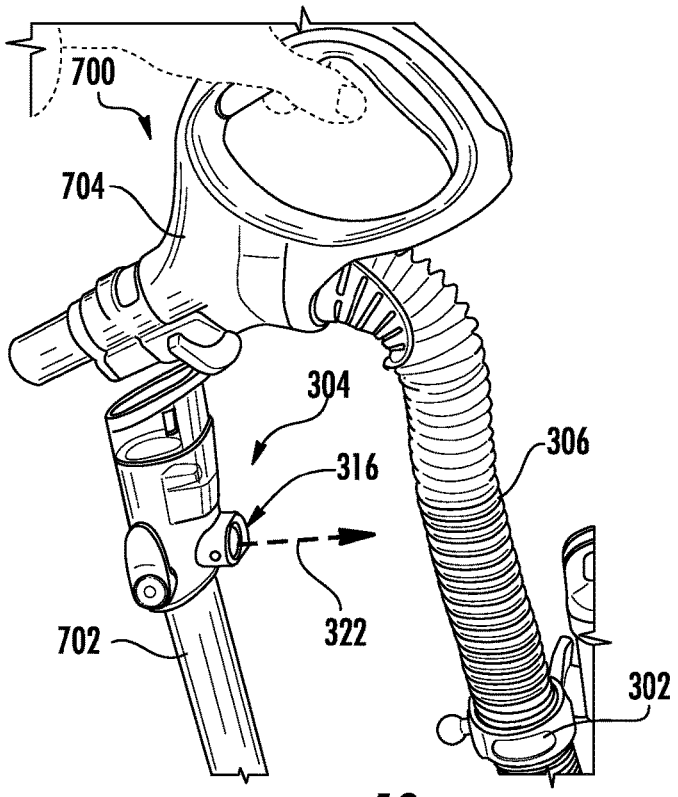
FIG. 10 is another example of the vacuum cleaning apparatus of FIG. 7, consistent with embodiments of the present disclosure.

As shown in FIG. 10, and with continued reference to the preceding figures, when the handle 704 is detached from the support structure 702, the suction hose 306 may be uncoupled from the coupler 304. The uncoupling may be accomplished by applying the removal force generally parallel to the center axis 322 of the coupler opening 316. This may be accomplished by an operator of the vacuum cleaning apparatus 700 exerting a force on the handle 704 that causes the suction hose 306 to exert a force on the hose ring 302. Additionally, or alternatively, the operator may exert a force directly on the hose ring 302 (e.g., by grasping and pulling on the hose ring 302).

Figure 11:
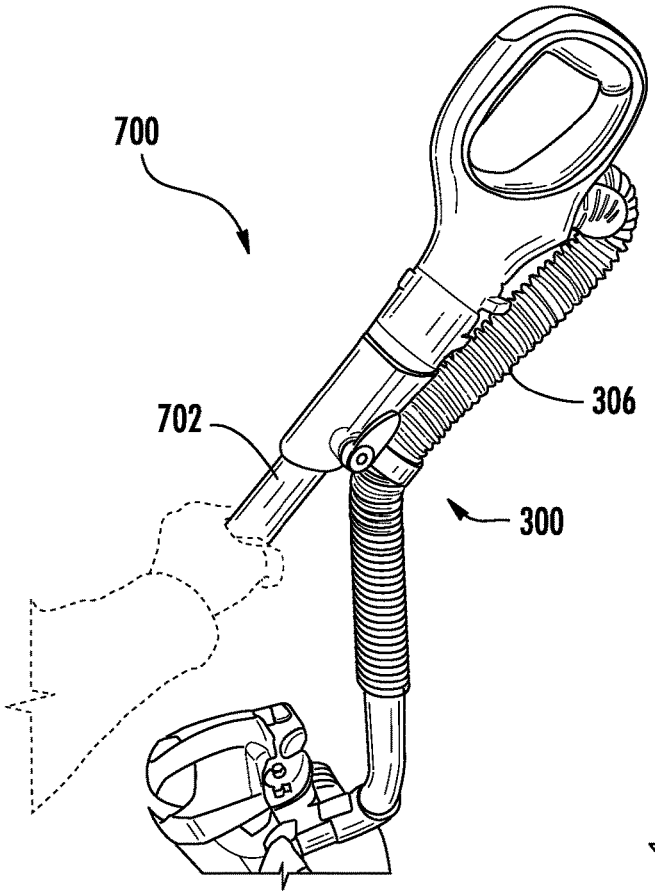
FIG. 11 is yet another example of the vacuum cleaning apparatus of FIG. 7, consistent with embodiments of the present disclosure.

Referring also to FIG. 11, in some embodiments, the support structure 702 may be detached from the surface cleaning head 712 (FIG. 7). For example, when the support structure 702 is coupled to the surface cleaning head 712 using one or more of a snap fit, friction fit, detent or other suitable forms of coupling that allow an operator of the vacuum cleaning apparatus 700 to attach and detach the support structure 702 from the surface cleaning head 712. When detached, various vacuum attachments may be coupled to the support structure 702 to provide additional versatility to the vacuum cleaning apparatus 700. As shown, when the support structure 702 is detached from the surface cleaning head 712, the suction hose 306 remains coupled to the support structure 702 using the hose clip 300.

Figure 12:
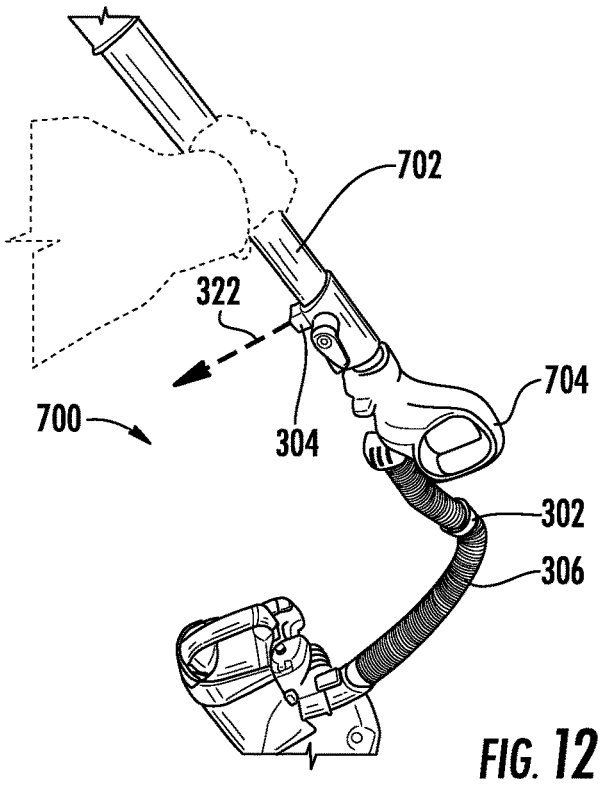
FIG. 12 is a further example of the vacuum cleaning apparatus of FIG. 7, consistent with embodiments of the present disclosure.

As shown in FIG. 12, and with continued reference to the preceding figures, when the support structure 702 is detached from the surface cleaning head 712 (FIG. 7), the suction hose 306 may be uncoupled from the coupler 304. The uncoupling may be accomplished by applying the removal force generally parallel to the center axis 322 of the coupler opening 316 (FIG. 3). This may be accomplished by an operator of the vacuum cleaning apparatus 700 exerting a force on the handle 704 that causes the suction hose 306 to exert a force on the hose ring 302. Additionally, or alternatively, the operator may exert a force directly on the hose ring 302 (e.g., by grasping and pulling on the hose ring 302).

In embodiments, both the handle 704 and the support structure 702 are detachable. In some embodiments only one of the handle 704 or the support structure 702 are detachable. In some embodiments neither the handle 704 nor the support structure 702 are detachable.

While the present disclosure generally refers to the hose ring 302 as having both the protrusion 310 and the coupling 314 and the coupler 304 as being coupled to the support structure 702, such a configuration is non-limiting. For example, the protrusion 310 and the coupling 314 may extend from the support structure 702 and the coupler 304 may be coupled to the hose ring 302.

Various features (e.g., one or more portions of the coupler 304, the handle 704, and the connector 718) are illustrated herein as transparent for the purposes of clarity and not by way of limitation.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaning apparatus comprising: a support structure; a suction hose; and a hose clip for coupling at least a portion of the suction hose to the support structure, wherein the hose clip includes: a hose ring slidably coupled to and extending completely around at least a portion of the suction hose, wherein the hose ring includes a protrusion; and a coupler coupled to the support structure, the coupler including a coupler housing having an opening for receiving at least a portion of the protrusion, the opening transitioning from an outer surface of the coupler housing into a coupler cavity defined by the coupler housing, wherein the coupler cavity includes a plurality of jaws for engaging at least a portion of the protrusion, wherein the plurality of jaws are configured to be slidable linearly in a direction away from a central axis extending from the opening, and the plurality of jaws include a tapered region facing the protrusion.

2. The vacuum cleaning apparatus of claim 1, wherein the protrusion includes a coupling.

3. The vacuum cleaning apparatus of claim 2, wherein at least a portion of the coupling is spherical.

4. The vacuum cleaning apparatus of claim 3, wherein an engaging surface for at least one jaw includes a recess having a curvature that generally corresponds to at least a portion of a spherical surface of the coupling.

5. The vacuum cleaning apparatus of claim 2, wherein the coupling has an insertion end width, an intermediary width, and a protrusion end width, the intermediary width measuring greater than the insertion end width and the protrusion end width.

6. The vacuum cleaning apparatus of claim 1, wherein, before the coupling is inserted into the coupler, a separation distance between the plurality of jaws measured at the tapered region is greater than or equal to the insertion end width.

7. The vacuum cleaning apparatus of claim 1, wherein the hose ring slideably engages the suction hose.

8. A vacuum cleaning apparatus comprising: a support structure having a first end and a second end; a handle coupled to the first end of the support structure; a debris collector coupled to the support structure; a suction motor fluidly coupled to the debris collector; a suction hose fluidly coupled to the debris collector and the support structure; a surface cleaning head fluidly coupled to the second end of the support structure, wherein the suction motor causes debris to be drawn into a dirty air inlet of the surface cleaning head and be deposited in the debris collector; and a hose clip for coupling at least a portion of the suction hose to the support structure, wherein the hose clip includes: a hose ring slidably coupled to and extending completely around at least a portion of the suction hose, wherein the hose ring includes a protrusion having an at least partially spherical shaped coupling; and a coupler coupled to the support structure, the coupler including a coupler housing having an opening for receiving at least a portion of the coupling, the opening transitioning from an outer surface of the coupler housing into a coupler cavity defined by the coupler housing, wherein the coupler cavity includes a plurality of jaws for engaging at least a portion of the coupling, wherein the plurality of jaws are configured to be slidable linearly in a direction away from a central axis extending from the opening and each of the plurality of jaws are urged towards the central axis by a corresponding biasing member, and the plurality of jaws include a tapered region facing the protrusion.

9. The vacuum cleaning apparatus of claim 8, wherein an engaging surface for at least one jaw includes a recess having a curvature that generally corresponds to at least a portion of a spherical surface of the coupling.

10. The vacuum cleaning apparatus of claim 8, wherein the coupling has an insertion end width, an intermediary width, and a protrusion end width, the intermediary width measuring greater than the insertion end width and the protrusion end width.

11. The vacuum cleaning apparatus of claim 8, wherein, before the coupling is inserted into the coupler, a separation distance between the plurality of jaws measured at the tapered region is greater than or equal to the insertion end width.

12. The vacuum cleaning apparatus of claim 8, wherein the handle fluidly couples the suction hose to the support structure.

13. The vacuum cleaning apparatus of claim 12, wherein the handle is detachable from the support structure.

14. The vacuum cleaning apparatus of claim 8, wherein the support structure is detachable from the surface cleaning head.

15. A vacuum cleaning apparatus comprising: a support structure; a debris collector coupled to the support structure; a suction motor fluidly coupled to the debris collector; a suction hose fluidly coupled to the debris collector; and a hose clip for coupling at least a portion of the suction hose to the support structure, wherein the hose clip includes: a hose ring slidably coupled to and extending completely around at least a portion of the suction hose, wherein the hose ring includes a protrusion; and a coupler, the coupler including a coupler housing having an opening for receiving at least a portion of the protrusion, the opening transitioning from an outer surface of the coupler housing into a coupler cavity defined by the coupler housing, wherein the coupler cavity includes a plurality of jaws for engaging at least a portion of the protrusion, wherein the plurality of jaws are configured to be slidable linearly in a direction away from a central axis extending from the opening and each of the plurality of jaws are urged towards the central axis, and the plurality of jaws include a tapered region facing the protrusion.

16. The vacuum cleaning apparatus of claim 15, wherein the protrusion includes an at least partially spherical shaped coupling having a truncated end region.

17. The vacuum cleaning apparatus of claim 16, wherein the coupler is coupled to the support structure.

* * * * *